US006064015A

United States Patent [19]

Braaten

[11] Patent Number: 6,064,015

[45] Date of Patent: May 16, 2000

[54] FOOT SWITCHES

[75] Inventor: Ronald J. Braaten, Woodstock, Conn.

[73] Assignee: Conntrol, International, Inc., Putnam, Conn.

[21] Appl. No.: 08/950,360

[22] Filed: Oct. 14, 1997

[51] Int. Cl.[7] ..... H01H 3/14

[52] U.S. Cl. ..... 200/86.5; 200/86.5

[58] Field of Search ..... 200/86.5; 74/512

[56] References Cited

U.S. PATENT DOCUMENTS

| | | | |
|---|---|---|---|
| 3,759,115 | 9/1973 | Dibonaventura et al. | 74/512 |
| 3,916,722 | 11/1975 | Grobe | 74/512 |
| 4,354,071 | 10/1982 | Pietschmann | 200/86.5 |
| 5,083,069 | 1/1992 | Jimenez et al. | 318/558 |

*Primary Examiner*—Michael L. Gellner
*Assistant Examiner*—Nhung Nguyen
*Attorney, Agent, or Firm*—Robert H. Montgomery

[57] ABSTRACT

A foot switch which comprises a housing member defining a hollow cavity bounded by front, back and side walls with a pair of spaced apart rib members within the housing spaced intermediate the side walls. Journaled between each side wall and a rib are generally U-shaped members having a first treadle and a second operating arm. The second arms are journaled in the housing and one of the ribs and the first treadle arms are accessible without the housing and adapted to rotate the first arms upon application of pressure. A torsion spring is positioned about each of the second arms between a side wall and a rib and arranged to bias the second arms into a predetermined position. At least one switch having an actuating arm is secured in the housing member. Switch arm actuating members are also secured within within the housing to act on the switch arms and are actuated by the second arms of the U-shaped members when the first arms are depressed under foot pressure. When depressed, the first arms rotate the second arms against the bias of the torsion springs to actuate the switch actuating arms through the switch actuating members.

38 Claims, 4 Drawing Sheets

FOOT SWITCHES

FIELD OF THE INVENTION

This invention relates to foot switches which are primarily directed to industrial and commercial use, but may also be used for domestic or residential use.

BACKGROUND OF THE INVENTION

Foot switches are used in many applications, industrial and commercial as well as residential. Industrial applications may include operation of power tools, conveyers, lifting devices, and many other applications. In many applications plural foot operated switches are utilized to control more than one operation or function. One common example is the up and down motions of a lifting or vertical positioning device.

Presently used foot switches generally comprise a pivotal actuating treadle to operate a switch arm or a switch actuator in a separate housing. A spring in some form is provided as a treadle return. Generally the actuating treadle is connected to a rotating shaft for operating a switch. In many cases known foot switches are subject to collecting debris which may be in the environment.

Accordingly, the present invention provides new and improved foot switches in which the operating mechanism including all springs and switches, usually a snap switch, is enclosed and shielded to prevent adverse effects by environmental debris and the actuating treadle directly acts on a switch actuating member.

The treadles comprise a bar or tubular stock in a generally U-shaped form having spaced apart operating and treadle arms with a connecting portion where the operating arm is preloaded with a torsion spring which complements the action of the treadle arm. This provides a very compact structure with a low profile and provides the user with a large target for his or her foot to operate the switch.

An object of this invention is to provide new and improved foot switches.

Another object of this invention is to provide new and improved foot switches where the entire operating mechanism is protected from environmental debris with a new and improved structure.

Another object of this invention is to provide new and improved foot switches enclosed within a cast housin where all operating parts are arranged in and supported in the housing.

A further object of this invention is to provide foot switches with a new and improved treadle/operating arm structure.

A still further object of this invention is to provide new and improved foot switches of simplified construction.

SUMMARY OF THE INVENTION

Briefly stated, the invention in one form thereof, comprises a housing member, which preferably is a casting, defining a hollow cavity bounded by front, back and side walls with a pair of spaced apart rib members within the housing and spaced intermediate the side walls. First and second generally U-shaped rod members having treadle arms and operating arms with a connecting portion therebetween are provided. The operating arms are journaled in a side wall and one of the ribs and the treadle arms are accessible without the housing. A torsion spring is positioned about each of the treadle arms between a sidewall and a rib and arranged to bias the second arms into a predetermined position. At least one switch having an operating member or arm is secured to the housing member in the cavity. A switch actuator member is secured within the cavity and acts on the switch operating member when actuatated by the operating arms when the treadle arms are depressed under foot pressure. When the depressed under foot pressure, the treadle arms rotate the operating arms against the bias of the torsion springs to actuate the switch operating members through the switch actuators members. When foot pressure is removed from the treadle arms, the torsion springs will return the operating arms to an inactive position.

A foot switch embodying the invention may be constructed using only one switch and with the ends of the treadle arms joined together. Also, only one switch and one U-shaped member may be utilized.

The features of the invention which are believed to be novel are particularly pointed out and distinctly claimed in the concluding portion of this specification. The invention, however, together with further objects and advantages thereof, may best be appreciated by reference to the following detailed description taken in conjunction with the drawings.

DETAILED DESCRIPTION OF THE DRAWINGS

DESCRIPTION OF PREFERRED EMBODIMENTS OF THE INVENTION

Figure 1:
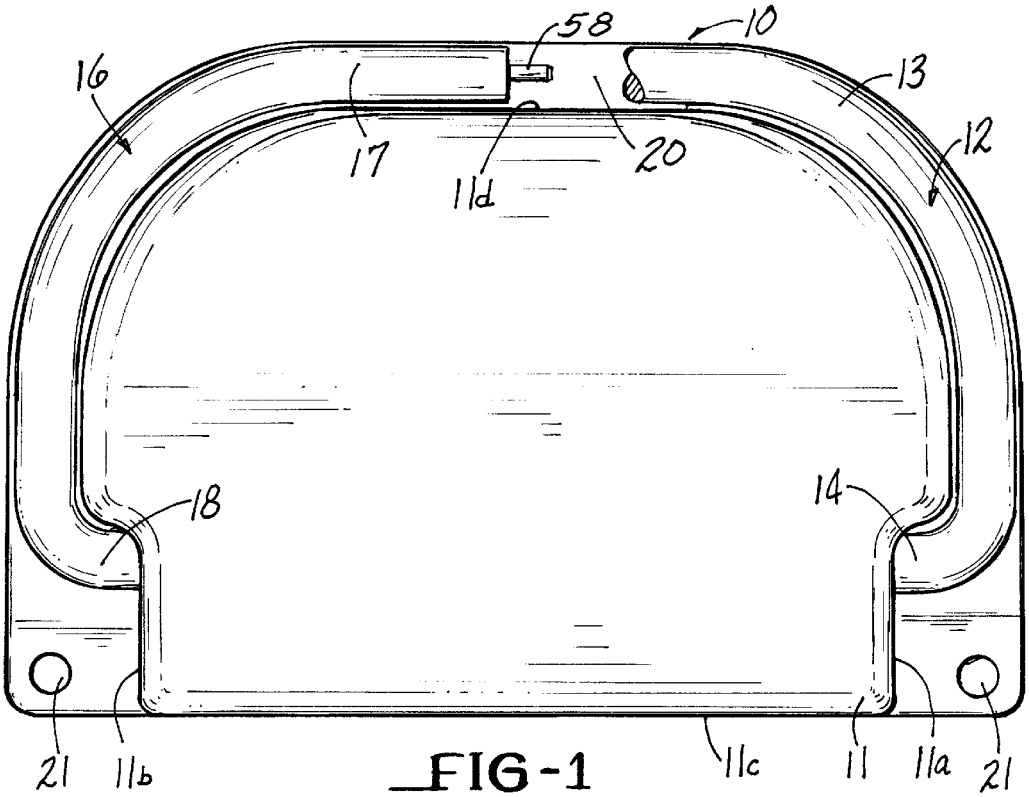
FIG. 1 is a top plan view of a first foot switch embodying the invention.

FIG. 1 exemplifies a first foot switch 10 embodying the invention which includes a housing member 11 having a top wall defining a cavity 22 therebelow. Housing member 11 further includes spaced apart side walls 11*a* and 11*b* and front and back walls 11*c* and 11*d*. As previously stated, housing 11 is preferably a casting. A first generally U-shaped rod member 12 having a first or treadle arm 13 and a second or operating arm 14 and a connecting portion 15 has arm 14 journaled in the side wall 11*a* of housing 11 as hereinafter described. A second similar generally U-shaped member 16 having a treadle arm 17 and an operating arm 18 and a connecting portion 19 has arm 18 journaled in side wall 11*b* of housing 11, also as hereinafter described. The U-shaped members 12 and 16 are preferably made of rod stock. Each of the U-shaped members 12 and 16 are one piece members providing spaced apart treadle and operating arms having free ends and a connecting portion joining the treadle and operating arms of each member at the other ends thereof.

As used herein the term rod stock refers to solid rod stock in any form, round or square in part, or tubular stock which is useful in practice of the invention.

Housing member 11 includes a lower flange 20 which provides a stop for treadle arms 13 and 17 when these arms are pivoted downwardly as will hereinafter be described and also provides a floor hold down fastening flange with screw holes 21.

Figure 2:
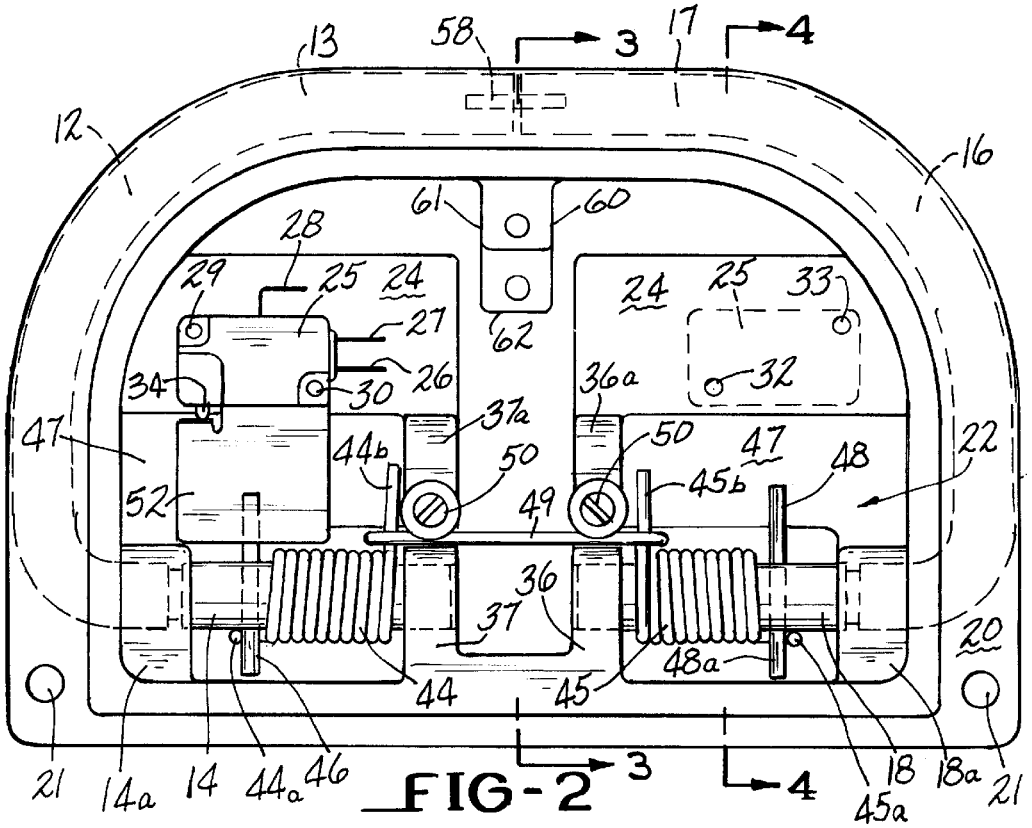
FIG. 2 is a bottom view of the foot switch of FIG. 1 with the bottom plate removed.
Figure 3:
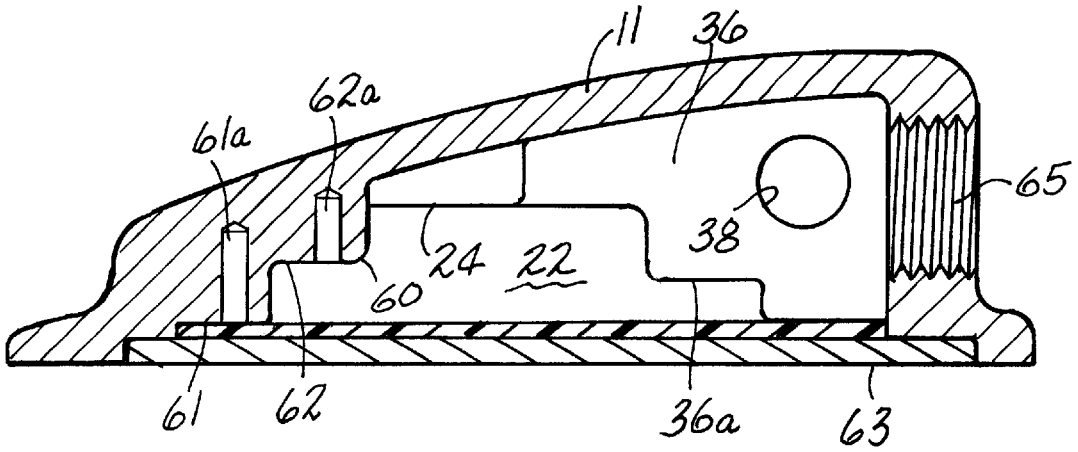
FIG. 3 is a sectional view seen in the plane of line 3—3 of FIG. 2, with the operational parts removed.
Figure 4:
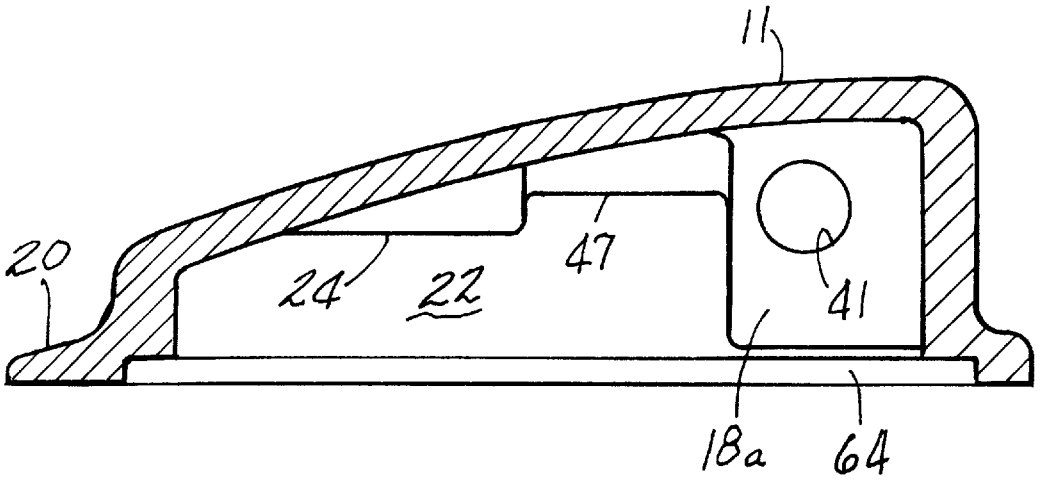
FIG. 4 is a sectional view seen in the plane of lines 4—4 of FIG. 2, with the operational parts removed.

Reference is now made to FIG. 2 which illustrates the underside of member 11 with the bottom cover plate removed and showing under cavity 22. The description of FIG. 2 is given in conjunction with FIGS. 3 and 4. FIGS. 3 and 4 show sections of housing 11 without the operating mechanisms of FIG. 2 therein in order to clearly exemplify surfaces defining the cavity 22.

The surfaces defined in cavity are symmetrical on either side of Section 3—3, and if Section 3—3 were reversed the view would be the mirror image of FIG. 3.

Member 11 which is preferably a casting of aluminum, steel or molded plastic presents first surfaces 24 adapted to have micro-switches 25 (one shown in phantom) attached thereto. Mirco-switches 25 may be of a type made by Micro Switch of Freeport, Ill., Model V3-2900-D9, which has normally open and normally closed terminals 26 and 27, and a common terminal 28. This switch has apertures for fastening screws 29 and 30 which are received in threaded apertures 32 and 33 in housing 11. The switches also include an operating member in the form of an arm 34 which is operated as hereinafter described.

The operating arms 14 and 18 are rotatably journaled in housing member 11 in bearing blocks 14*a* and 18*a* respectively, which are preferably integral with and form a portion of housing 11. Spaced apart bearing members in the form of ribs 36 and 37 are also defined in housing 11. The end of arm 18 is journaled in bearing 38 (FIG. 3) in rib 36 and the end of arm 14 is journaled in corresponding rib 37. Bearing block 18*a* is shown in FIG. 4 and bearing block 14*a* is a mirror image therof. Bearing block 18*a* defines a bearing 41 (FIG. 4) for arm 18. Bearing block 14*a* defines a similar bearing for arm 14.

Disposed about leg 14 is a torsion spring 44 and disposed about leg 18 is a torsion spring 45. Extending through leg 14 is a pin 46 which at one end engages an end 44*a* of spring 44. The other end of pin 46 normally tests on surface 47 or a seat defined thereon under the bias of spring 44. A pin 48 extends through leg 18 and engages at end 48*a* thereof an end 45*a* of spring 45. The other end of pin 48 normally rests on another surface 47 or a seat defined thereon under the bias of spring 45.

The ends of springs 44 and 45, 44*b* and 45*b* respectively, are prevented from movement by a hold down rod 49 which is secured to surfaces 36*a* and 37*a* of ribs 36 and 37, respectively, by screws 50. With this arrangement when arm 13 is depressed arm 14 will rotate, pin 46 will act on end 44*a* of spring 44 and spring 44 will be tensioned and store energy therein to return arm 13 to its normal position when the depressing force is removed from arm 13.

The operation of spring 45, leg 18, pin 48 is the same when leg 17 is depressed.

Figure 5:
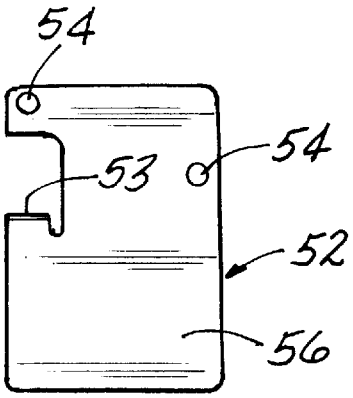
FIG. 5 is a view of a switch actuating member utilized in the invention.

A switch actuator 52 is acted upon by either pin 46 or pin 48. Only one switch 25, and one actuator member 52 have been shown in FIG. 2 for simplicity and clarity of disclosure. A switch actuating member 52 is shown for actuator switch 25 in FIG. 2 and also in FIG. 5.

The switch actuator member 52 is stamped or otherwise formed of a resilient sheet with a tab 53 extending substantially perpendicular therefrom and is provided with holes 54 for receiving screws 29 and 30 therethrough. The upper portion (as viewed in FIGS. 2 and 5) is positioned between a surface 24 and a switch 25 and both the switch 25 and actuator member 52 are secured in cavity 22 to housing 11 by screws 29 and 30. The lower portion 56 overlies pin 46. The tab 53 is positioned to engage switch arm 34 when lower portion 56 is flexed upwardly (as viewed in FIG. 2) by pin 46 and actuate switch 25.

The members 12 and 16 may be operated independently to actuate either of the switches 25. Alternatively, if only one switch is used in a given application the ends of arms 13 and 17 may be connected. This alternative is exemplified by a pin 58 in FIGS. 1 and 2. It will be understood that if a two switch mechanism is desired, the pin 58 is not utilized, and the ends of arms 13 and 17 are not connected.

Figure 8:
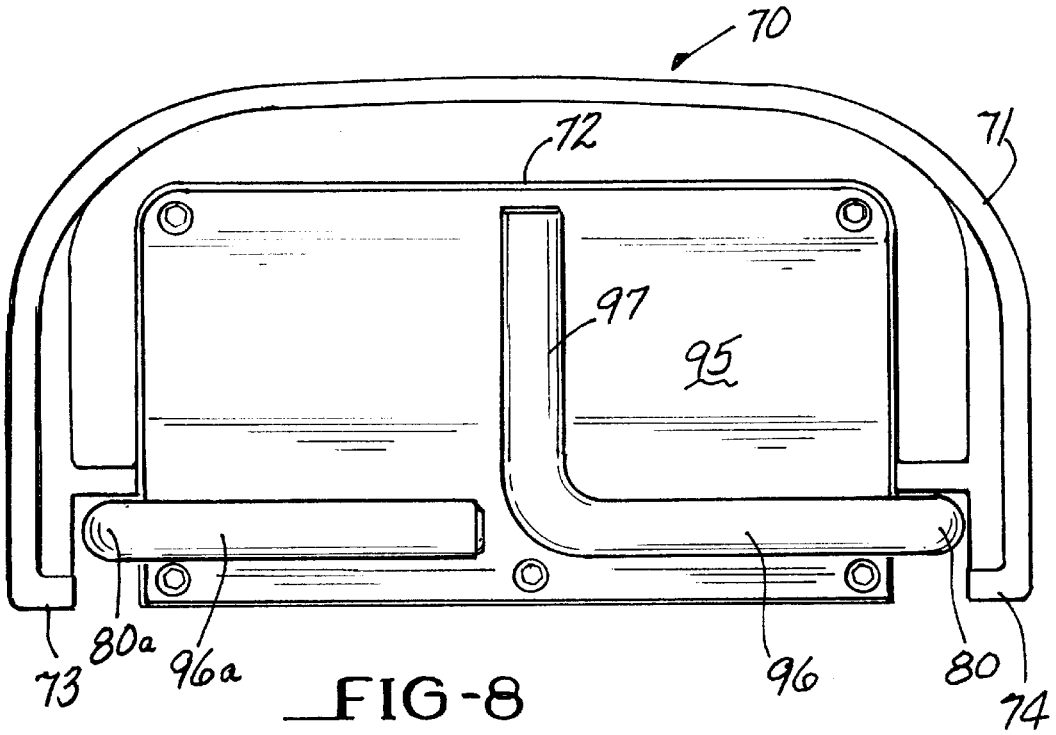
FIG. 8 is a view seen in the plane of lines 8—8 of FIG. 6 with the cover plate of the switching mechanism in place.

The end of one of arms 14 or 18 may have a perpendicular continuation as shown in FIG. 8 in order that inadvertant operation of both switches at the same time is prevented.

As shown in FIGS. 2 and 3, housing 11 is formed with a projection 60 having surfaces 61 and 62. An aperture 61*a* is defined in member 60 through surface 61 to receive a fastner for a bottom cover plate 63, shown only in FIG. 3. Cover plate 63 with sealing gasket is received in a recess 64 (FIG. 4) defined in housing 11. An aperture 62*a* is defined in projection 60 through surface 62 for receipt of a ground wire fastening screw (not shown).

A threaded opening 65 is defined in a wall of housing 11 to

The operating arms 14 and 18 have circular recesses 14*b* and 18*b*, respectively defined therein to receive O-ring seals, not shown.

It may be seen that the operating mechanism is sealed within housing member 11 and protected against any environmental debris or other foreign matter. It has previously been pointed out that the housing 11 is symmetrical on either side of the plane of lines 3—3 of FIG. 2. Either one or two switches may be included in the embodiment of FIGS. 1 and 2. If only one switch is included one of the torsion springs may be eliminated or it may be retained to provide a given resistance to foot depression or provide back-up.

In another alternative, a foot switch may be constructed in accordance with the invention using a single switch within a housing which is essentially only half of housing 11 as may be seen in FIG. 3. In such construction only one U-shaped rod member, one torsion spring and one swich actuator is utilized, and the exterior of the housing may be made symmetrical for aesthetic purposes.

Figure 7:
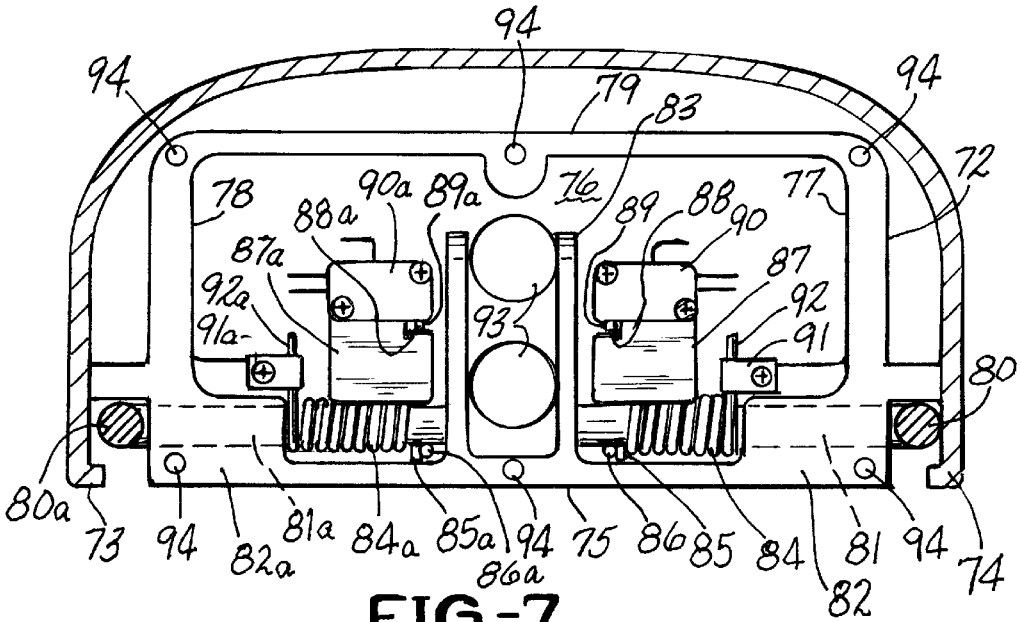
FIG. 7 is a view seen in the plane of lines 7—7 of FIG. 6 with the cover plate of the switching mechanism removed.

In such one switch embodiment, the operating arm need only be journaled in one elongated bearing block, as exemplified by bearing blocks 82 and 82*a* in FIG. 7.

In the foot switches thus far disclosed the switch arm actuating pins 46 and 48 are angularly disposed in arms 14 and 18, respectively, and biased by the torsion springs, such that the actuators members 52 do no switch actuator the switches until the treadle arms 13 and/or 17 are depressed and the bias of the springs are overcome. The flange 20 limits the downward movement of the treadle arms.

The invention may also be embodied in a guarded foot switch where the top guard or shroud is integral with a housing similar to housing 11. Such guarded foot switches may be used in applications where caution is required against possible falling objects or other inadvertant operation of a foot switch.

Figure 6:
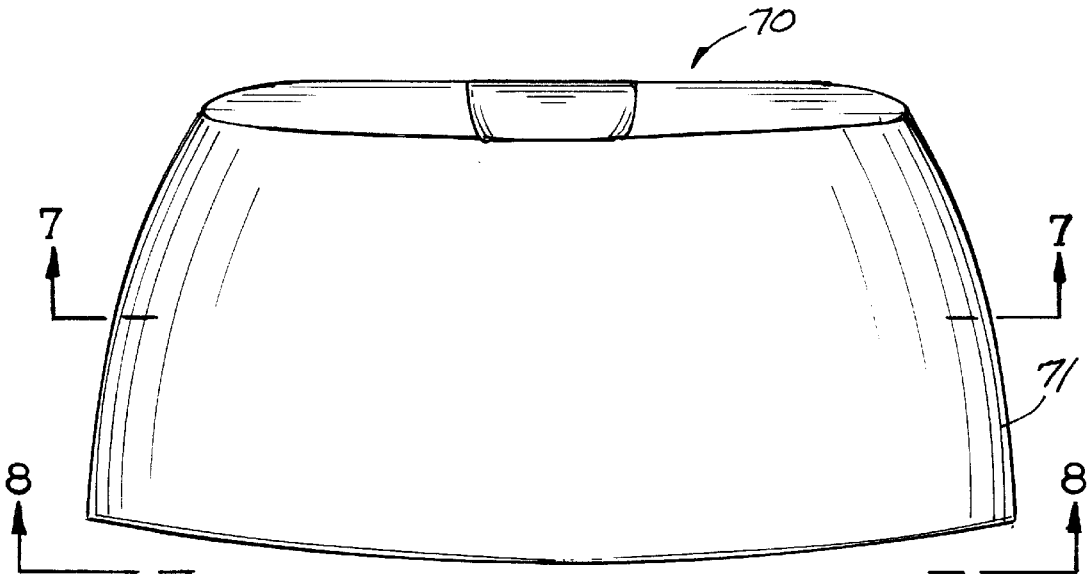
FIG. 6 is a top plan view of a guarded foot switch embodying the invention.

Reference is now made to FIGS. 6–8. A guarded foot switch 70 comprises a shroud-like member 71 having a housing member 72 cast integral therewith. In an operational position member 71 rests on feet 73 and 74 and on wall 75 of housing 72. In this embodiment the housing 72 for the operating mechanism is generally vertically arranged. Housing 72 defines a cavity 76 defined by spaced apart side walls 77 and 78, a top wall 79 similar to wall lid of housing 11 and bottom wall 75 similar to wall 11*c* of housing 11.

A first generally U-shaped member 80 has an operating arm 81 journaled in a bearing block 82 integral with side wall 77 and the end of arm 81 journaled in a bearing member in the form of rib 83. A torsion spring 84 is disposed about arm 81 in cavity 76. A pin 85 extends through arm 81 and through the last coil 86 of spring 84 for reasons previously described and extends under a switch actuator member 87 in the same manner as member 52 has an upstanding tab 88 arranged to act on switch operating member 89 of a switch 90. A tab 91 screwed or otherwise secured to housing 72 restrains end 92 of torsion spring 84.

One or more openings 93 are defined in housing 72 to receive a cable or wiring to the switches in housing 72. The openings are threaded to receive a coupling member.

A plurality of screw holes 94 are defined in housing 72 to secure a cover plate 95 to housing 72 as shown in FIG. 8.

Reference is now made to FIG. 8. Member 80 has an arm 96 without housing 72, but within shroud 71. The treadle portion of arm 96 is generally horizontal and has a upturned generally vertical continuation continuation 97 which will isolate treadle arm 96 and treadle arm 96*a* of member 80 and prevent inadvertent operation of both switches at the same time. As previously mentioned the same construction may be utilized on either of the treadle arms 12 or 16 of the embodiment shown in FIGS. 1 and 2.

In FIG. 7 it will be seen that the switch operating mechanism on the left is symmetrical with that previously described on the right and corresponding parts are identified with the same reference numeral with the suffix a annexed thereto.

A second U-shaped member 80*a* has an operating arm 81*a* journaled in a bearing block 82*a* integral with side wall 78 and the end of arm 81*a* journaled in a bearing member in the form of rib 83*a*. A torsion spring 84*a* is disposed about arm 81*a* in cavity 76. A pin 85*a* extends through arm 81*a* and through the last coil 86*a* of a spring 84*a* for reasons previously described and extends under a switch actuator member 87*a* in the same manner as member 52 described in FIGS. 2 and 5. Switch arm actuating member 87*a* has an upstanding tab 88*a* arranged to act on the switch operating member of a switch 90*a*. A tab 91*a* is screwed or otherwise secured to housing 72 restrains end 92*a* of torsion spring 84*a*. Switches 90 and 90*a* are secured to the housing member by screws identified by the reference numerals 89 and 89*a*, respectively.

The operation of the embodiment of FIGS. 6–8 is the same as described previously in conjunction with the embodiment of FIGS. 1–5 and need not be further described except to state that the downward movement of the treadle arms are limited by the surface upon which the foot switch 70 is mounted. Alternatively, a stop pin may be inserted through arms 81 and 81*a* to limit rotation.

While FIGS. 6–8 illustrate a double foot switch with a guard, the invention may be embodied in a single guarded foot switch with a smaller but similarly shaped housing.

It may thus be seen that the objects of the invention set forth above as well as those made apparent are efficiently attained. While preferred embodiments of the invention have been set forth for purposes of disclosure, modifications of the disclosed embodiments as well as other embodiments of the invention may occur to others which do not depart from the spirit and scope of the invention. Accordingly, the appended claims are intended to cover all embodiments of the invention as well as modifications to the disclosed embodiments which do not depart from the spirit and scope of the invention.

What is claimed is:

1. A foot switch comprising a housing member defining a cavity bounded by a top wall, spaced apart side walls and spaced apart walls joining said side walls, a generally U-shaped member having spaced apart treadle and operating arms having free ends and a connecting portion joining said arms at the other ends thereof, said operating arm extending into and being rotatably journaled in one of said side walls and said treadle arm being outside of said housing member and arranged to be depressed by foot pressure whereby upon depression said treadle arm rotates said operating arm, resilient biasing means acting on said operating arm within said housing cavity and biasing said treadle arm into a predetermined position for depression by foot pressure, said treadle arm upon depression thereof rotating said operating arm, a switch in said cavity having an operating member, said operating arm upon rotation thereof causing actuation of said switch operating member.

2. The foot switch of claim 1 wherein said housing a member is a casting and includes a lower outwardly extending flange which stops downward movement of said treadle arm.

3. The foot switch of claim 1 wherein said cavity is below said top wall and further including a bottom cover member enclosing said housing cover member.

4. The foot switch of claim 1 wherein said housing is a casting and further includes a bearing block cast integral therewith, the free end of said operating arm extending through and being rotatably journaled in said bearing block.

5. The foot switch of claim 4 further including sealing means about said operating arm where said operating arm is journaled in said bearing block.

6. The foot switch of claim 1 further including an actuator member for said switch operating member and means on said operating arm for causing said actuator member to act on said switch operating member.

7. The foot switch of claim 1 wherein said resilient biasing means is a torsion spring disposed about said operating arm.

8. The foot switch of claim 4 further including another bearing member cast integral with said housing and spaced from said bearing block, said another bearing member rotatably receiving the free end of said operating arm.

9. The foot switch of claim 6 wherein said means on said operating arm is a pin extending from said operating arm and positioned to act on said actuator member.

10. The foot switch of claim 1 further including an actuator member for said switch operating member, said resilient biasing means is a torsion spring disposed about said operating arm, a pin extending from said operating arm and anchoring one end of said torsion spring, said pin upon rotation of said operating arm contacting said actuator member and causing said actuator member to act on said switch operating member.

11. The foot switch of claim 1 wherein said housing member is cast integrally with a guard overlying said treadle arm.

12. The foot switch of claim 1 wherein said U-shaped member is formed in one piece from rod stock.

13. A foot switch comprising a housing member defining a cavity bounded by a top wall, side walls, and walls joining said side walls, first and second generally U-shaped members each having spaced apart treadle and operating arms having free ends and a connecting portion joining said arms at the other ends thereof, each of said operating arms extending into and being rotatably journaled in one of said side walls, said treadle arms being outside of said housing, resilient biasing means in said housing acting on said operating arms and biasing said treadle arms into a position to be depressed by foot pressure, at least one switch in said housing, said at least one switch having an operating member, one of said operating arms upon rotation thereof causing actuation of said switch operating member.

14. The foot switch of claim 13 wherein said housing member includes a lower outwardly extending flange which stops downward movement of said treadle arm.

15. The foot switch of claim 13 wherein said cavity is below said top wall and further including a cover member enclosing said housing member cavity.

16. The foot switch of claim 13 wherein said housing member is a casting which includes bearing blocks at each side wall for rotatably supporting one of said operating arms, additional bearing members within and cast integral with said housing and spaced from said bearing blocks, each of said bearing members rotatably receiving a free end of one of said operating arms.

17. The foot switch of claim 13 further including sealing means about said operating arms where said operating arms are journaled in said housing.

18. The foot switch of claim 13 wherein said resilient biasing means is a torsion spring disposed about said operating arm acting on said at least one switch.

19. The foot switch of claim 13 further including an actuator member for said switch operating member, said operating arm upon rotation thereof causing said actuator member to act on said switch operating member.

20. The foot switch of claim 19 further including a pin extending from said operating arm and positioned to act on said actuator member.

21. The foot switch of claim 13 further including an actuator member for said switch operating member, said resilient biasing means is a torsion spring disposed about said operating arm, a pin extending from said operating arm and anchoring one end of said torsion spring, said pin upon rotation of said operating arm contacting said actuator member and causing said actuator member to act on said switch operating member.

22. The foot switch of claim 13 wherein only one switch is contained within said housing and said treadle arms are joined at their ends whereby foot pressure on either of said treadle arms will operate said only one switch.

23. The foot switch of claim 13 where two switches are in said housing and positioned so that each may be selectively operated by a respective one of said treadle arms.

24. The foot switch of claim 23 wherein said treadle arms are generally horizontally disposed and one of said treadle arms has an end portion which extends generally vertically from the horizontal portion thereof.

25. The foot switch of claim 13 wherein said U-shaped members are formed in one piece from rod stock.

26. A foot switch comprising a housing member defining a cavity bounded by a top wall, side walls and walls joining said side walls, first and second generally U-shaped members each having spaced apart treadle and operating arms, said arms of each U-shaped member having free ends and a connecting portion between said arms at the other ends thereof, each of said operating arms being rotatably journaled in said housing through one of said side walls, said treadle arms being outside of said housing, resilient biasing means in said housing acting on said operating arms and biasing said treadle arms into a position to be depressed by foot pressure, switches in said housing, each of said switches having an operating member, each of said operating arms upon rotation thereof causing actuation of said switch operating member.

27. The foot switch of claim 26 wherein said housing member is a casting which includes bearing blocks at each side wall for rotatably supporting one of said operating arms, additional bearing members within and cast integral with said housing and spaced from said bearing blocks, each of said bearing members rotatably receiving a free end of one of said operating arms.

28. The foot switch of claim 26 further including sealing means about said operating arms where said operating arms are journaled in said housing.

29. The foot switch of claim 27 wherein said resilient biasing means acting on said operating arms are torsion springs disposed about each of said operating arms between a bearing block and a another bearing member.

30. The foot switch of claim 26 wherein said housing member is a casting and further includes bearing blocks cast integral therewith at each side wall, the free ends of each of said operating arms extending into and being rotatably supported in one of said bearing blocks.

31. The foot switch of claim 30 further including a guard overlying said treadle arms and being cast integral with said housing member.

32. The foot switch of claim 26 wherein said treadle arms are generally horizontally disposed and one of said treadle arms extends generally vertically from the horizontal portion thereof.

33. The foot switch of claim 26 wherein said housing member is a casting and includes a lower outwardly extending flange which stops downward movement of said treadle arm.

34. The foot switch of claim 26 further including a cover member enclosing said housing member cavity.

35. The foot switch of claim 26 further including sealing means about said operating arms where said operating arms are journaled in said housing.

36. The foot switch of claim 26 further including actuator member for each of said switch operating members, said operating arms upon rotation thereof causing said actuator members to act on said of switch operating members.

37. The foot switch of claim 36 further including a pin extending from each of said operating arms and positioned to act on one of said actuator members.

38. The foot switch of claim 26 further including an actuator member for each of said switch operating members, said resilient biasing means is a torsion spring disposed about each of said operating arms, a pin extending from each of said operating arms and anchoring one end of a torsion spring, said pins upon rotation of said operating arms contacting an associated actuator member and causing said associated actuator member to act on a switch operating member.

* * * * *